US006022657A

United States Patent [19]

Fuller, Jr. et al.

[11] Patent Number: 6,022,657

[45] Date of Patent: Feb. 8, 2000

[54] METHODS OF MAKING CHARGE GENERATION LAYERS CONTAINING CHARGE TRANSPORT COMPOUND, AND PHOTOCONDUCTORS CONTAINING THE SAME

[75] Inventors: Sterritt R. Fuller, Jr.; Gregory Walter Haggquist, both of Longmont; Laura Lee Kierstein, Johnstown; Ronald Harold Levin; Scott Thomas Mosier, both of Boulder; Jennifer Kaye Neely, Arvada; Catherine Mailhé Randolph, Niwot, all of Colo.

[73] Assignee: Lexmark International, Inc., Lexington, Ky.

[21] Appl. No.: 09/219,331

[22] Filed: Dec. 22, 1998

[51] Int. Cl.[7] ..... G03G 5/047

[52] U.S. Cl. ..... 430/59.1; 430/134

[58] Field of Search ..... 430/83, 57.1, 58.05, 430/59.1, 134

[56] References Cited

U.S. PATENT DOCUMENTS

| | | | |
|---|---|---|---|
| 5,043,238 | 8/1991 | Monbaliu et al. . | |
| 5,164,276 | 11/1992 | Robinson et al. | 430/83 |
| 5,238,766 | 8/1993 | Molaire et al. . | |
| 5,437,950 | 8/1995 | Yu et al. . | |
| 5,656,407 | 8/1997 | Kawahara | 430/78 |

*Primary Examiner*—John Goodrow
*Attorney, Agent, or Firm*—John A. Brady

[57] ABSTRACT

Methods of making a charge generation layer comprise premixing a charge generation compound, a charge transport compound and solvent to form a premix essentially free of polymeric binder, mixing the premix with at least one polymeric binder to form a dispersion, and coating the dispersion on a substrate. Photoconductors comprising a substrate, a charge transport layer and a charge generation layer formed by such a method exhibit improved electrical sensitivity.

22 Claims, 3 Drawing Sheets

METHODS OF MAKING CHARGE GENERATION LAYERS CONTAINING CHARGE TRANSPORT COMPOUND, AND PHOTOCONDUCTORS CONTAINING THE SAME

FIELD OF THE INVENTION

The present invention is directed to methods of making charge generation layers including a charge transport compound and to photoconductors containing such charge generation layers.

BACKGROUND OF THE INVENTION

In electrophotography, a latent image is created on the surface of an imaging member such as a photoconducting material by first uniformly charging the surface and then selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner.

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to use of a charge transport layer which comprises a hole transport material as the charge transport compound. One skilled in the art will appreciate that if the charge transport layer contains an electron transport material rather than a hole transport material, the charge placed on a photoconductor surface will be opposite that described herein.

Generally, when the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer comprises a polymeric binder containing a charge generation compound or molecule while the charge transport layer comprises a polymeric binder containing the charge transport compound or molecule. The charge generation compounds within the CGL are sensitive to image-forming radiation and photogenerate electron-hole pairs within the CGL as a result of absorbing such radiation. The CTL is usually non-absorbent of the image-forming radiation and the charge transport compounds serve to transport holes to the surface of a negatively charged photoconductor. Photoconductors of this type are disclosed in the Adley et al U.S. Pat. No. 5,130,215 and the Balthis et al U.S. Pat. No. 5,545,499.

Generally, by increasing the content of the charge transport compound in the charge transport layer, faster imaging speeds and reduced residual voltages may be obtained. However, when the amount of the charge transport compound in the charge transport layer is increased above about 40 to 50 weight percent, based on the weight of the charge transport layer, the mechanical properties of the photoconductor often begin to suffer and increased wear rates and reduced mechanical strength result. Several references have disclosed the use of certain amounts of specific charge transport compounds or the use of a charge transport polymer in charge generation layers, for example in the Champ et al U.S. Pat. No. 4,490,452, the Kato et al U.S. Pat. No. 4,882,253 and the Umeda et al U.S. Pat. No. 5,677,094. However, as photoconductors of improved sensitivity and durability and improved performance over extended photoconductor life are continually desired, particularly at lower cost, there is a continuing need for the development of new materials and methods to meet these demands.

SUMMARY OF THE INVENTION

Accordingly, it is an object of the present invention to provide photoconductors which exhibit improved properties and/or performance. More particularly, it is an object of the present invention to provide dual layer photoconductors which exhibit improved electrical performance, including improved sensitivity.

These and additional objects and advantages are provided by the methods of making charge generation layers according to the present invention and by the photoconductors according to the present invention. The methods of making a charge generation layer according to the present invention comprise premixing a charge generation compound, a charge transport compound and a solvent to form a premix essentially free of polymeric binder, mixing the premix of the charge generation compound, the charge transport compound and the solvent with at least one polymeric binder to form a dispersion, and coating the dispersion on a substrate. Preferably, the premix includes a solvent in which the charge transport compound is soluble. The resulting charge generation layer provides improved electrical performance, particularly increased sensitivity, to photoconductors in which it is employed. Typically, the photoconductors are dual layer photoconductors and comprise a substrate, a charge transport layer and a charge generation layer. The charge transport layer comprises binder and a first charge transport compound, while the charge generation layer comprises binder, a charge generation compound and a second charge transport compound, wherein the charge generation layer is made by the previously described process which comprises premixing the charge generation compound, the charge transport compound and a solvent to form a premix essentially free of polymeric binder, mixing the premix with at least one polymeric binder to form a dispersion, and coating the dispersion on a substrate.

The methods according to the present invention form charge generation layers which, when employed in photoconductors, provide the photoconductors with good electrical performance, including good sensitivity.

These and additional objects and advantages will be further apparent in view of the following detailed description.

BRIEF DESCRIPTION OF THE DRAWING

The present invention as set forth in the detailed description will be more fully understood when viewed in connection with the following drawing figures in which.

DETAILED DESCRIPTION

Figure 1:
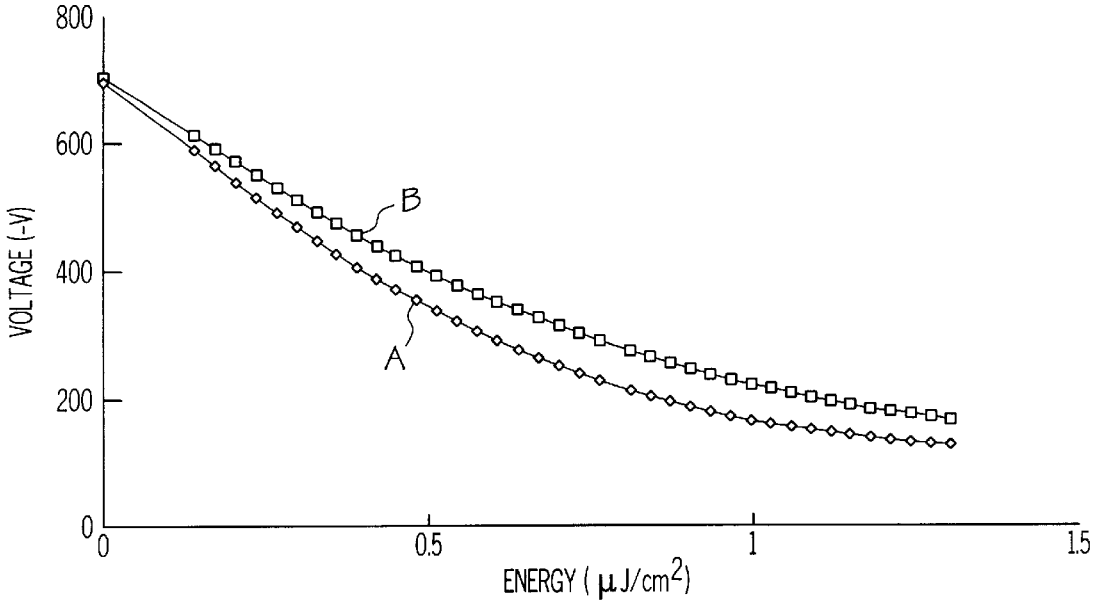
FIG. 1 sets forth electrical performance properties of a photoconductor A according to the present invention wherein the charge generation layer includes a charge transport compound and is made according to the present methods, and electrical performance properties of a conventional photoconductor B wherein the charge generation layer is free of charge transport compound, as described in Example 1.

In a first embodiment, the invention is directed to methods of making a charge generation layer which comprises both a charge generation compound and a charge transport compound. Charge generation layers of this type, and dual layer photoconductors containing such charge generation layers, are set forth in the Levin et al U.S. application Ser. No. 09/066,284 filed Apr. 24, 1998, the entire disclosure of which is incorporated herein by reference. Such charge generation lay containing both a charge generation compound and a charge transport compound are advantageous in that photoconductors employing such charge generation layers exhibit good electrical performance, including good sensitivity and/or good residual voltage, and/or they exhibit noticeable reductions in dark decay as compared with conventional photoconductors wherein the charge generation layer does not contain a charge transport compound. In the embodiments of the present invention wherein the charge generation layer comprising both a charge generation compound and a charge transport compound is made by premixing the charge generation compound and the charge transport compound to form a premix essentially free of polymeric binder, further improvements in photoconductor electrical sensitivity may be obtained.

Typically, a charge generation layer is prepared from a charge generation dispersion of a charge generation compound, a polymeric binder and a solvent, and the dispersion is subjected to milling or grinding whereby the charge generation compound is milled or ground in the presence of the binder and the solvent. In accordance with the methods of the present invention, the charge generation compound is first premixed with the charge transport compound and the solvent, and the premix is essentially free of the polymeric binder. The charge generation compound can be milled or ground either before it is premixed with the charge transport compound or after it is premixed with the charge transport compound. If the charge generation compound is milled or ground before it is premixed with the charge transport compound, it is preferred that the premix of the charge generation compound and the charge transport compound is mixed substantially before addition of any polymeric binder in order to ensure thorough mixing and provide a homogenous premix before the binder addition.

The premix of the charge generation compound and the charge transport compound preferably includes a solvent in which the charge generation compound is dispersed and in which the charge transport compound is soluble. Suitable solvents will be apparent to those skilled in the art, particularly in view of the specific charge transport compounds which are employed therein. Examples of suitable solvents include, but are not limited to, ketones, ethers and mixtures thereof.

The premix is essentially free of the polymeric binder. Within the scope of the present invention, essentially free of polymeric binder means that the premix only contains polymeric binder in an amount which does not prevent local concentration of charge transport compound molecules around the charge generation compound molecules in the premix. Preferably, the premix contains less than about 10 weight percent of polymeric binder, more preferably less than 5 weight percent of polymeric binder and even more preferably less than about 1 weight percent of polymeric binder. In further preferred embodiments, the premix contains no polymeric binder.

Although the present inventors do not intend to be bound by any one theory, it is believed that the step of forming a premix of the charge generation compound and the charge transport compound, and essentially free of the polymeric binder, permits a more efficient injection of electrons from the charge transport compound to the photoexcited charge generation material in the resulting photoconductor. It is believed that the electron transfer involved in the injection step is sensitive to the distance between the charge generation molecules and the charge transport molecules, with short distances being preferred, and to the local concentration of charge transport molecules around the charge generation molecules, with higher concentrations being preferred. By premixing the charge generation crystals in the presence of the charge transport molecules, without the binder being present, it is believed that the concentration of charge transport molecules on or around the charge generation crystals may be increased, that the distance between the charge generation molecules and the charge transport molecules may be decreased, and that the charge transport molecules can adsorb directly to the surface of the charge generation crystals without having to displace binder from the surface of the charge generation crystals in the charge generation layer of the photoconductor.

The premix comprises the charge generation compound and the charge transport compound in relative amounts which will provide the desired ratio of charge generation compound and charge transport compound in the final charge generation layer. In one embodiment, the premix comprises from about 5 to about 90 weight percent of the charge generation compound and from about 10 to about 90 weight percent of the charge transport compound, based on the total content of the charge generation compound and the charge transport compound. More preferably, the premix comprises from about 25 to about 75 weight percent of the charge generation compound and from about 25 to about 75 weight percent of the charge transport compound, based on the total content of the charge generation compound and the charge transport compound. In further preferred embodiments, the premix comprises from about 1 to about 50, more preferably from about 5 to about 20, weight percent of the charge generation compound, from about 1 to about 50, more preferably from about 5 to about 20, weight percent of the charge transport compound, and from about 5 to about 98, more preferably from about 60 to about 90, weight percent of the solvent, based on the total weight of the premix.

Once the charge generation compound and the charge transport compound are sufficiently mixed with one another in the premix, the binder is added to the premix to form a charge generation dispersion. Additional solvent may be added to the dispersion, and the binder may be added all at once or over time in a number of additions, with the intermediate dispersions being milled, stirred, or otherwise processed between binder additions. The resulting charge generation dispersion, doped with the charge transport compound, may be used to form a charge generation layer of a photoconductor exhibiting improved sensitivity.

The final dispersion comprises the charge generation compound, the charge transport compound and the polymeric binder in amounts suitable for providing the desired charge generation layer composition upon evaporation of the solvent therefrom, and includes the solvent in an amount sufficient to allow appropriate coating of the dispersion on a substrate, preferably by dip coating or a similar conventional technique. In one embodiment, the final dispersion for coating comprises from about 5 to about 60 weight percent of the charge generation compound, from about 5 to about 60 weight percent of the charge transport compound, and from about 10 to about 90 weight percent of the polymeric binder, based on the total content of the charge generation compound, the charge transport compound and the polymeric binder. More preferably, the dispersion comprises from about 20 to about 50 weight percent of the charge generation compound, from about 20 to about 50 weight percent of the charge transport compound, and from about 20 to about 75 weight percent of the polymeric binder, based on the total content of the charge generation compound, the charge transport compound and the polymeric binder. In further preferred embodiments, the dispersion comprises from about 0.1 to about 30, more preferably from about 1 to about 10, weight percent of the charge generation compound, from about 0.1 to about 30, more preferably from about 1 to about 10, weight percent of the charge transport compound, from about 0.1 to about 30, more preferably from about 1 to about 10, weight percent of the polymeric binder and from about 10 to about 99, more preferably from about 75 to about 98, weight percent of the solvent, based on the total weight of the dispersion.

Various charge generation compounds which are known in the art are suitable for use in the methods of making charge generation layers and the photoconductors according to the present invention. Organic charge generation compounds are suitable for use in the present photoconductors, examples of which include, but are not limited to, disazo compounds, for example as disclosed in the Ishikawa et al U.S. Pat. No. 4,413,045, tris and tetrakis compounds as known in the art, phthalocyanine dyes, including both metal-free forms such as X-form metal-free phthalocyanines and the metal-containing phthalocyanines such as titanium-containing phthalocyanines as disclosed in U.S. Pat. Nos. 4,664,997, 4,725,519 and 4,777,251, polymorphs and derivatives thereof, and squaric acid-derived dyes, for example hydroxy-squaraine charge generation compounds. In a preferred embodiment, the charge generation layer includes a phthalocyanine compound. Both metal-free forms and metal-containing forms of the phthalocyanines are preferred. A particularly preferred charge generation compound for use in the charge generation layer according to the present invention comprises metal-containing phthalocyanines, and more particularly metal-containing phthalocyanines wherein the metal is a transition metal or a group IIIA metal. Of these metal-containing phthalocyanine charge generation compounds, those containing a transition metal such as copper, titanium or manganese or containing aluminum as a group IIIA metal are preferred. It is further preferred that the metal-containing phthalocyanine charge generation compound is oxy, thiol or dihalo substituted. Oxo-titanyl phthalocyanines are especially preferred, including various polymorphs thereof, for example type IV polymorphs, and derivatives thereof, for example halogen-substituted derivatives such as chlorotitanyl phthalocyanines.

The final charge generation layer comprises the charge generation compound in conventional amounts suitable for providing the charge generation effects. Suitably, the charge generation layer comprises at least about 5 weight percent, based on the weight of the charge generation layer, of the charge generation compound, and preferably at least about 10 weight percent, based on the weight of the charge generation layer. In further preferred embodiments, the charge generation layer comprises at least about 15 weight percent of the charge generation compound and preferably from about 15 to about 50 weight percent of the charge generation compound, based on the weight of the charge generation layer.

The charge transport compound which is included in the charge generation layer may be the same as or different from the charge transport compound which is included in the charge transport layer. In the photoconductors of the present invention, the inclusion of the charge transport compound in the charge generation layer improves the electrical performance, for example, sensitivity and/or residual voltage, of the photoconductor, without incurring increased wear rates or reducing the mechanical strength of the photoconductor owing to high charge transport layer loadings. Additionally, the inclusion of the charge transport compound in the charge generation layer may provide the photoconductors of the present invention with significant reductions in dark decay phenomenon. Typically, the charge transport compound in the charge generation layer acts as a dopant in the layer to provide these improvements.

The charge transport compound which is included in the charge generation layer may comprise any of the charge transport compounds conventionally known in the art, including, but not limited to, those discussed below for use in the charge transport layer. In a preferred embodiment, the charge transport compound included in the charge generation layer comprises a hydrazone compound, an aromatic amine (including aromatic diamines and triamines) or a substituted aromatic amine (including substituted aromatic diamines and triamines), or mixtures thereof.

Preferably, the charge transport compound is included in the charge generation layer in an amount sufficient to provide a dopant effect. More preferably, the charge transport compound is included in the charge generation layer in an amount sufficient to improve one or more characteristics of the electrical performance of the photoconductor, for example to provide increased sensitivity and/or improved residual voltage, and/or to reduce dark decay charge losses of the photoconductors. In a preferred embodiment, the charge transport compound is included in an amount of from about 10 to about 50 weight percent, based on the weight of the charge generation layer. In further embodiments, the weight ratio of the charge generation compound to the charge transport compound contained in the charge generation layer is not less than about 1:3 and more preferably not less than about 1:2. Suitably, the weight ratio of the charge generation compound to the charge transport compound contained in the charge generation layer is from about 10:1 to about 1:3.

The polymeric binder of the charge generation layer may be any polymeric binder known in the art for use in charge generation layers. Preferably, the binder of the charge generation layer is inactive, i.e, it does not exhibit either charge generation or charge transporting properties, and may comprise, but is not limited to, vinyl polymers such as polyvinyl chloride, polyvinyl butyral, polyvinyl acetate, styrene polymers, and copolymers of these vinyl polymers, acrylic acid and acrylate polymers and copolymers, polycarbonate polymers and copolymers, including polyestercarbonates, polyesters, alkyd resins, polyamides, polyurethanes, epoxy resins and the like. Preferably, the charge generation layer comprises the binder in an amount of from about 10 to about 90 weight percent and more preferably in an amount of from about 20 to about 75 weight percent, based on the weight of the charge generation layer.

The charge generation layers made according to the processes of the invention are suitable for use in photoconductors, particularly dual layer photoconductors. The dual layer photoconductors according to the present invention comprise a substrate, a charge transport layer and a charge generation layer formed by the methods as described above.

The photoconductor substrate may be flexible, for example in the form of a flexible web or a belt, or inflexible, for example in the form of a drum. Typically, the photoconductor substrate is uniformly coated with a thin layer of a metal, preferably aluminum, which functions as an electrical ground plane. In a further preferred embodiment, the aluminum is anodized to convert the aluminum surface into an aluminum oxide surface. Alternatively, the ground plane member may comprise a metallic plate, such as aluminum or nickel, a metallic drum or foil, or a plastic film on which aluminum, tin oxide or indium oxide or the like is vacuum evaporated.

In a preferred embodiment, the charge generation layer may be formed on the photoconductor substrate, followed by formation of the charge transport layer containing a hole transport compound, whereby a negative charge may be placed on the photoconductor surface. Conversely, the charge transport layer containing a hole transport compound may be formed on the photoconductor substrate and the charge generation layer is in turn formed on the charge transport layer, whereby a positive charge may be placed on the photoconductor surface. On the other hand, as one skilled in the art will appreciate, if the charge transport layer contains an electron transport material, the charges which may be placed on the photoconductor surface as a result of the arrangement of the charge transport and charge generation layers will be reversed.

The charge transport layer included in the dual layer photoconductors according to the present invention comprises binder and a charge transport compound. The charge transport layer is in accordance with conventional practices in the art and therefore may include any binder and any charge transport compound generally known in the art for use in charge transport layers. Typically, the binder is polymeric and may comprise any of the binders noted above for use in the charge generation layer. Preferably, the polymeric binder of the charge transport layer is inactive, i.e., it does not exhibit charge transporting properties.

Conventional charge transport compounds suitable for use in the charge transport layer of the photoconductors of the present invention should be capable of supporting the injection of photo-generated holes or electrons from the charge generation layer and allowing the transport of these holes or electrons through the charge transport layer to selectively discharge the surface charge. Suitable charge transport compounds for use in the charge transport layer include, but are not limited to, the following:

1. Diamine transport molecules of the types described in U.S. Pat. Nos. 4,306,008, 4,304,829, 4,233,384, 4,115,116, 4,299,897, 4,265,990 and/or 4,081,274.

2. Pyrazoline transport molecules as disclosed in U.S. Pat. Nos. 4,315,982, 4,278,746 and 3,837,851.

3. Substituted fluorene charge transport molecules as described in U.S. Pat. No. 4,245,021.

4. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Pat. No. 3,895,944.

5. Hydrazone transport molecules as described, for example, in U.S. Pat. No. 4,150,987 or in U.S. Pat. Nos. 4,385,106, 4,338,388, 4,387,147, 4,399,208, 4,399,207, 4,256,821 and 4,297,426.

Preferably, the charge transport compound included in the charge transport layer comprises a hydrazone, an aromatic amine (including aromatic diamines or triamines), a substituted aromatic amine (including substituted aromatic diamines and triamines), or a mixture thereof. Preferred hydrazone transport molecules include derivatives of aminobenzaldehydes, cinnamic esters or hydroxylated benzaldehydes. Exemplary amino benzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. applications Ser. Nos. 08/988,600 and 08/988,791, respectively, all of which patents and applications are incorporated herein by reference.

When the charge transport compound of the charge transport layer is different from the charge transport compound of the charge generation layer, it is preferred that the charge transport compound of the charge transport layer has an oxidation potential (commonly referred to as a redox potential $E_{redox}$) which is less than the oxidation potential of the charge transport compound of the charge generation layer or which is not more than about 0.2 V greater than the oxidation potential of the charge transport compound of the charge generation layer. This permits hole injection from the charge transport compound of the charge generation layer to the charge transport compound of the charge transport layer as required in an efficient device. More preferably, when the charge transport compound of the charge transport layer differs from the charge transport compound of the charge generation layer, the charge transport compound of the charge transport layer has an oxidation potential less than that of the charge transport compound of the charge generation layer.

Generally, when two or more charge transport compounds are mixed within a charge transport layer, significant trapping is exhibited if the charge transport compounds have substantially different oxidation potentials, typically greater than about 0.2 V. Accordingly, as is known in the art, for mixtures of charge transport compounds employed in a single charge transport layer, the compounds are selected such that their oxidation potentials do not differ by more than about 0.2 V and preferably do not differ by more than about 0.1 V. Because some amount of mixing is expected to occur at the interface of the charge generation layer and the charge transport layer in the photoconductors of the present invention, one would expect that a substantial similarity in the oxidation potentials of the respective charge transport compounds of the charge transport layer and the charge generation layer according to the present invention would be required. Surprisingly, it has been determined that photoconductors having good electrical performance may be obtained using different charge transport compounds in the charge transport layer and the charge generation layer, respectively, even when the oxidation potential of the charge transport compound in the charge generation layer is substantially greater than that of the charge transport compound in the charge transport layer. Photoconductors having good electrical performance may be obtained using different charge transport compounds in the charge transport layer and the charge generation layer, respectively, even when the oxidation potential of the charge transport compound in the charge generation layer is more than about 0.1 V greater or more than about 0.2 V greater than that of the charge transport compound in the charge transport layer.

The charge transport layer typically comprises the charge transport compound in an amount of from about 5 to about 60 weight percent, based on the weight of the charge transport layer, and more preferably in an amount of from about 15 to about 40 weight percent, based on the weight of the charge transport layer, with the remainder of the charge transport layer comprising the binder, and any conventional additives.

The photoconductor imaging members described herein may be prepared according to conventional techniques, as long as the charge generation layer is prepared from a premix of charge generation compound and charge transport compound as described above. Typically, the photoconductor substrate will have a thickness adequate to provide the required mechanical stability. The charge generation layer will typically have a thickness of from about 0.05 to about 5.0 microns, and the charge transport layer will have a thickess of from about 10 to about 40 microns. In accordance with techniques known in the art, one or more barrier layers may be provided between the ground plane and the charge generation layer, typically having a thickness of from about 0.05 to about 20 microns. The charge transport layer is formed by dispersing and/or dissolving the charge transport compound in a polymeric binder and solvent, coating the dispersion and/or solution on the respective underlying layer and drying the coating.

Various embodiments of the photoconductors according to the present invention are illustrated in the following examples. In the examples and throughout the present specification, parts and percentages are by weight unless otherwise specified.

EXAMPLE 1

In this example, a photoconductor A according to the present invention and a conventional photoconductor B were prepared. In each photoconductor, a charge generation layer was dip-coated on an anodized aluminum substrate and a charge transport layer was dip-coated on the charge generation layer. The charge transport layer of each photoconductor comprised about 70 weight percent of a polymer binder and about 30 weight percent of a charge transport compound comprising N,N'-bis-(3-methylphenyl)-N,N'-bis-phenylbenzidine (TPD) of the formula:

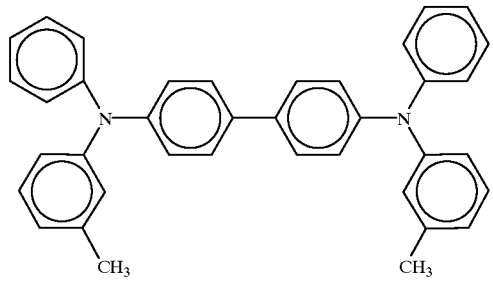

The charge generation layer of the photoconductor according to the invention, photoconductor A, comprised about 40 weight percent oxo-titanyl phthalocyanine (TiOpc) Type I pigment, about 27 weight percent binder and about 33 weight percent of TPD as the charge transport compound. The charge generation layer of the conventional photoconductor, photoconductor B, was free of charge transport compound and comprised about 40 weight percent TiOpc Type I pigment and about 60 weight percent binder.

The charge generation layer of photoconductor A of this example was prepared using a premix according to the present invention. Specifically, TiOpc Type I pigment was slurried (12 weight percent solids) with a solvent comprising a 20:80 mixture of methyl ethyl ketone (MEK) and cyclohexanone. The slurry was milled for a residence time of approximately 1 hour, after which the TPD was added and the resulting slurry was then stirred for two hours. After this milling and stirring, a binder solution comprising approximately 12 weight percent polyvinylbutyral (PVB) in MEK was added, resulting in a mill base comprising 16.8% of the components comprising the pigment, TPD and binder (40.4% TiOpc pigment, 32.7% TPD and 26.9% PVB, by weight) and 83.2% solvent (MEK:cyclohexanone in a 52:48 ratio). Milling was then conducted for approximately two additional hours. A final dispersion was prepared by diluting the mill base with a very dilute solution of PVB binder in MEK. The final dispersion composition comprised 4.4% of the components comprising pigment, TPD and binder (40% TiOpc pigment, 33% TPD and 27% binder), by weight, in 95.6% solvent (MEK:cyclohexanone in a 90:10 ratio). Photoconductor A was prepared using this final dispersion to form the charge generation layer. Photoconductor B was prepared from a conventional dispersion of the 40% TiOpc pigment and 60% binder in solvent. The TPD was not included in the dispersion.

The photoconductors of this example were subject to sensitivity measurements using a sensitometer fitted with electrostatic probes to measure the voltage magnitude as a function of light energy shining on the photoconductor surface. The sensitometer included a charging source designed to charge the photoconductor to about −700 V. The photosensitivity curve is generated by measuring the photoconductor's residual voltage after exposure to a range of light energies, in micro joules/cm$^2$. The results of these measurements are set forth in FIG. 1. Surprisingly, photoconductor A (curve A in FIG. 1) exhibited an improved photosensitivity curve and residual voltage as compared with photoconductor B (curve B in FIG. 1). The improved photosensitivity curve of photoconductor A is demonstrated by the sharper slope of curve A as compared with curve B in the low energy region.

EXAMPLE 2

In this example, a photoconductor C according to the present invention and comparative photoconductors D, E and F were prepared. In each photoconductor, a charge generation layer was dip-coated on an anodized aluminum substrate and a charge transport layer was dip-coated on the charge generation layer. The charge transport layer of each photoconductor comprised about 70 weight percent of a polymer binder and about 30 weight percent of a charge transport compound comprising TPD.

The charge generation layer of the photoconductor C according to the invention and the charge generation layer of the comparative photoconductor D each comprised about 30 weight percent TiOpc Type IV pigment, about 37 weight percent binder and about 33 weight percent of TPD as the charge transport compound. The charge generation layer of the comparative photoconductors E and F were free of charge transport compound and comprised about 45 weight percent TiOpc Type IV pigment and about 55 weight percent binder.

The charge generation layer of photoconductor C of this example was prepared using a premix according to the methods of the present invention. Specifically, TiOpc Type IV pigment was slurried (12 weight percent solids) with a solvent comprising a 20:80 mixture of MEK and cyclohexanone. The slurry was milled for a residence time of approximately 15 minutes, after which the TPD was added and the resulting slurry was then stirred for two hours. After this milling and stirring, a binder solution comprising approximately 12 weight percent PVB in a mixture of MEK and cyclohexanone (62:38 ratio) was added, resulting in a mill base comprising 16.8% of the components comprising pigment, TPD and binder (39% TiOpc pigment, 43% TPD and 18% PVB, by weight) and 83.2% solvent (MEK:cyclohexanone in a 1:2 ratio). Milling was then conducted for approximately two additional hours. A final dispersion was prepared by diluting the mill base with a very dilute solution of PVB binder in MEK. The final dispersion composition comprised 4.4% of the components comprising pigment, TPD and binder (30% TiOpc pigment, 33% TPD and 37% binder, by weight) in a 90:10 MEK:cyclohexanone solvent. Photoconductor C was prepared using this final dispersion to form the charge generation layer.

The charge generation layer of the comparative photoconductor D was prepared using the same procedure as that described for the charge generation layer of Photoconductor C except that the TPD was not added to the TiOpc Type IV pigment to form a premix. Rather, the TPD was added to the TiOpc Type IV pigment together with the PVB binder. The TiOpc Type IV pigment was slurried in solvent and subjected to the milling step to investigate the effect of milling in the absence of both the charge transport compound and the binder. The charge generation layer of comparative photoconductor E was prepared using the same procedure as that of photoconductor C, including the milling step, except that TPD was not included in the premix or in the charge generation layer dispersion. The comparative photoconductor F was prepared from a conventional dispersion of the TiOpc pigment and binder in a solvent, and TPD was not included in the dispersion.

Figure 2:
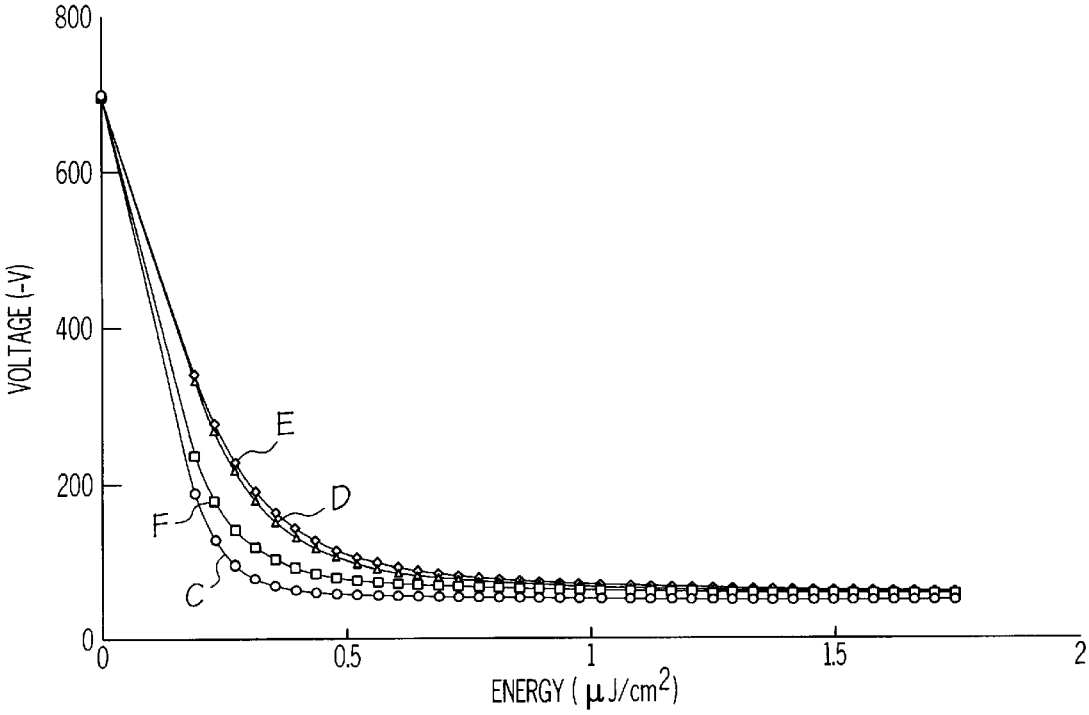
FIG. 2 sets forth electrical performance properties of a photoconductor C according to the present invention wherein the charge generation layer includes a charge transport compound and is made according to the present methods, and electrical performance properties of three comparative photoconductors, D, E and F, as described in Example 2.

The photoconductors of this example were subjected to sensitivity measurements in accordance with the procedures set forth in Example 1. The results are set forth in FIG. 2. The results in FIG. 2 demonstrate that photoconductor C according to the invention exhibited improved sensitivity as compared with comparative photoconductors D, E and F.

EXAMPLE 3

In this example, a photoconductor according to the present invention, photoconductor G, and two comparative photoconductors, photoconductors H and I were prepared. In each photoconductor, a charge generation layer was dip-coated on an anodized aluminum substrate and a charge transport layer was dip-coated on the charge generation layer. The charge transport layer of each photoconductor comprised about 60 weight percent of a polymer binder and about 40 weight percent of a charge transport compound comprising 4-N,N-diphenylaminobenzaldehyde-N',N'-diphenylhydrazone (TPH) of the formula:

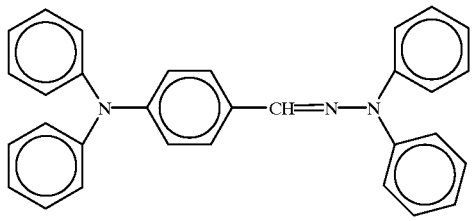

The charge generation layer of the photoconductor G according to the invention comprised about 30 weight percent TiOpc Type I pigment, about 37 weight percent binder and about 33 weight percent of TPH. The charge generation layer was formed from a dispersion prepared from a premix of the charge generation compound, the TPH charge transport compound and solvent, which premix was free of the binder, in accordance with the general procedures of Example 1. The charge generation layer of the comparative photoconductor H was free of charge transport compound and comprised about 34 weight percent TiOpc Type I pigment and about 66 weight percent binder, and was prepared from a conventional dispersion of pigment and binder in a solvent. The charge generation layer of the comparative photoconductor I comprised about 30 weight percent TiOpc Type I pigment, about 37 weight percent binder and about 33 weight percent of TPH. Unlike the charge generation layer of photoconductor G, the charge generation layer of comparative photoconductor I was prepared from a dispersion wherein the charge generation compound and the charge transport compound were not combined in a premix essentially free of binder, but rather the charge transport compound and the binder were mixed with the charge generation compound at about the same time.

Figure 3:
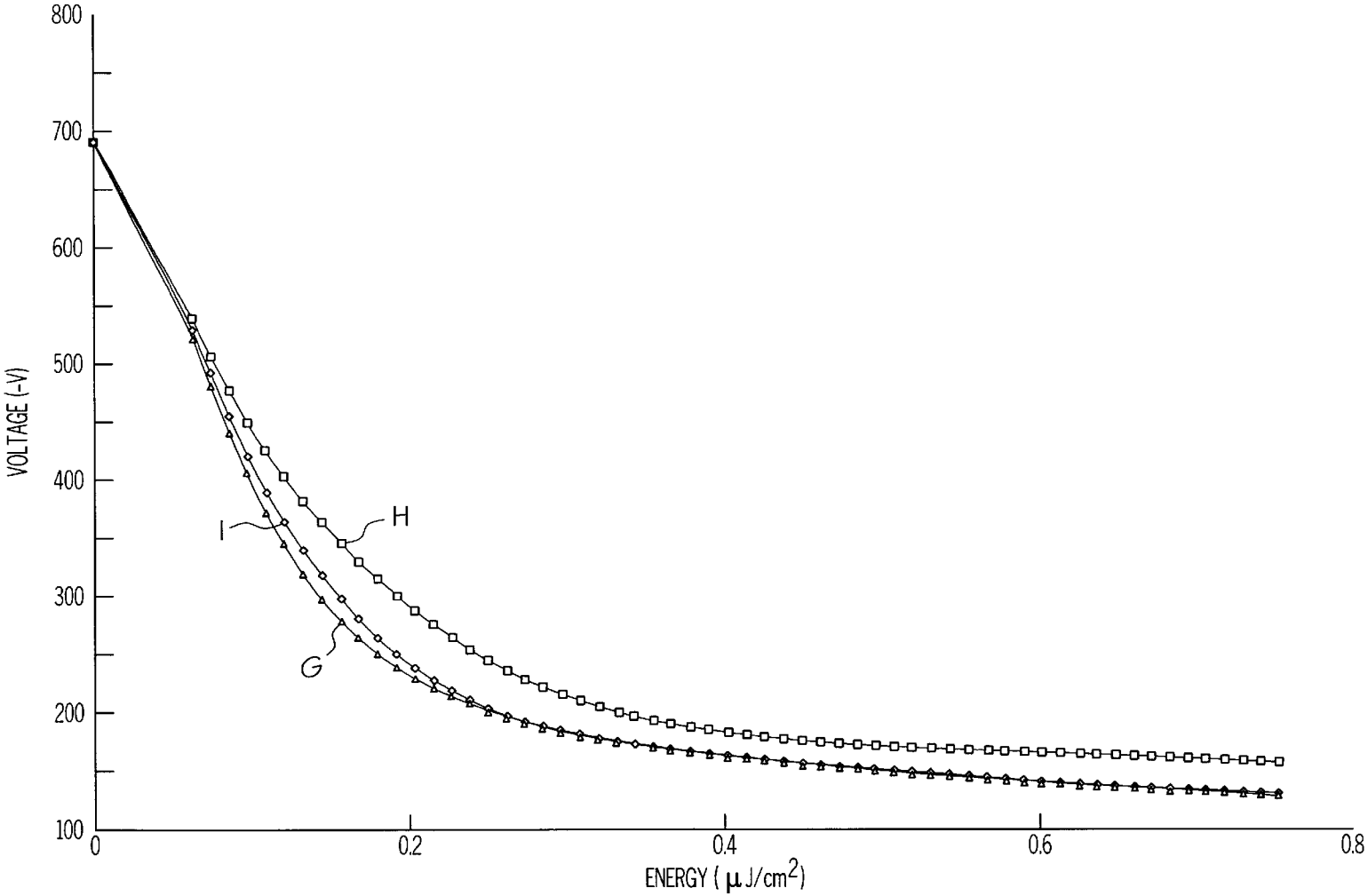
FIG. 3 sets forth electrical performance properties of a photoconductor G according to the present invention wherein the charge generation layer includes a charge transport compound and is made according to the present methods, and electrical performance properties of comparative photoconductors H and I, as described in Example 3.

The photoconductors of this example were subjected to sensitivity measurements using the procedure generally described in Example 1. The results of these measurements are set forth in FIG. 3. Photoconductor G exhibited a noticeable increase in sensitivity as compared with the comparative photoconductors H and I.

EXAMPLE 4

This example further demonstrates the improvement exhibited by photoconductors wherein the charge generation layer was prepared according to the methods of the present invention and wherein the charge generation layer contained a charge transport compound which is different from the charge transport compound of the charge transport layer. In each photoconductor, a charge generation layer was dip-coated on an anodized aluminum substrate and a charge transport layer was dip-coated on the charge generation layer. The charge transport layer of each photoconductor comprised about 60 weight percent of a polymer binder and about 40 weight percent of a charge transport compound comprising 4-N,N-diethylaminobenzaldehyde-N',N'-diphenylhydrazone (DEH) of the formula:

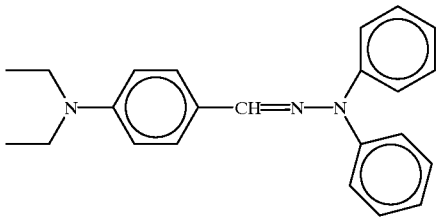

The charge generation layer of photoconductor J according to the invention was formed from a dispersion prepared according to the two-step process described in Example 3 and comprised 33% TPD, 30% TiOpc and 37% polymeric binder, by weight. For comparison purposes, comparative photoconductor K was prepared and included a charge generation layer comprising 30% TiOpc pigment and 70% polymeric binder, in the absence of TPD.

Figure 4A:
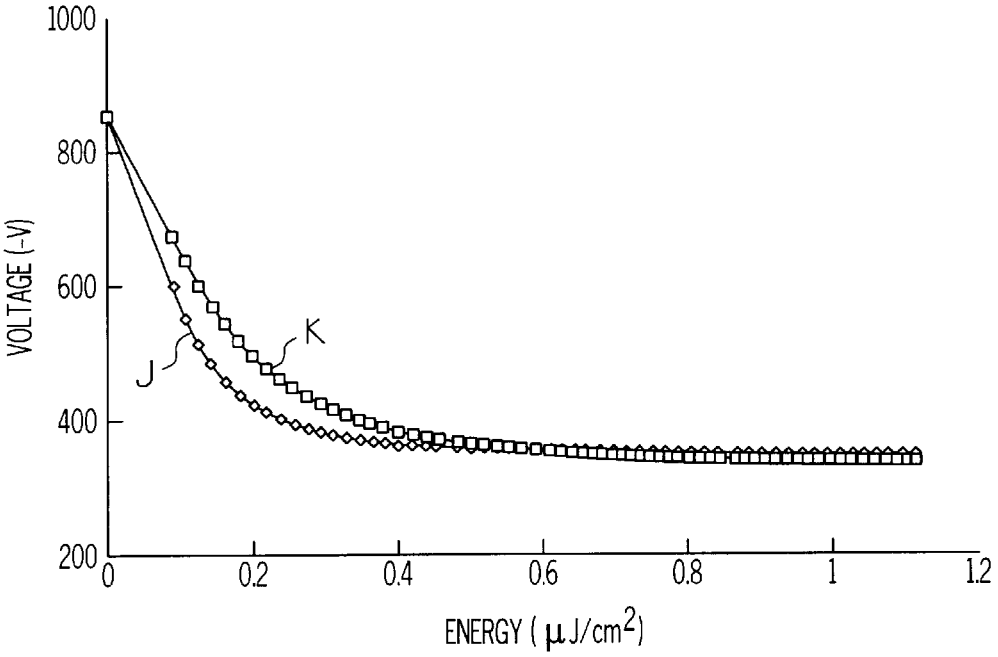
FIGS. 4A and 4B set forth electrical performance properties of a photoconductor J made according to the methods of the present invention and of a comparative photoconductor K, as described in Example 4.
Figure 4B:
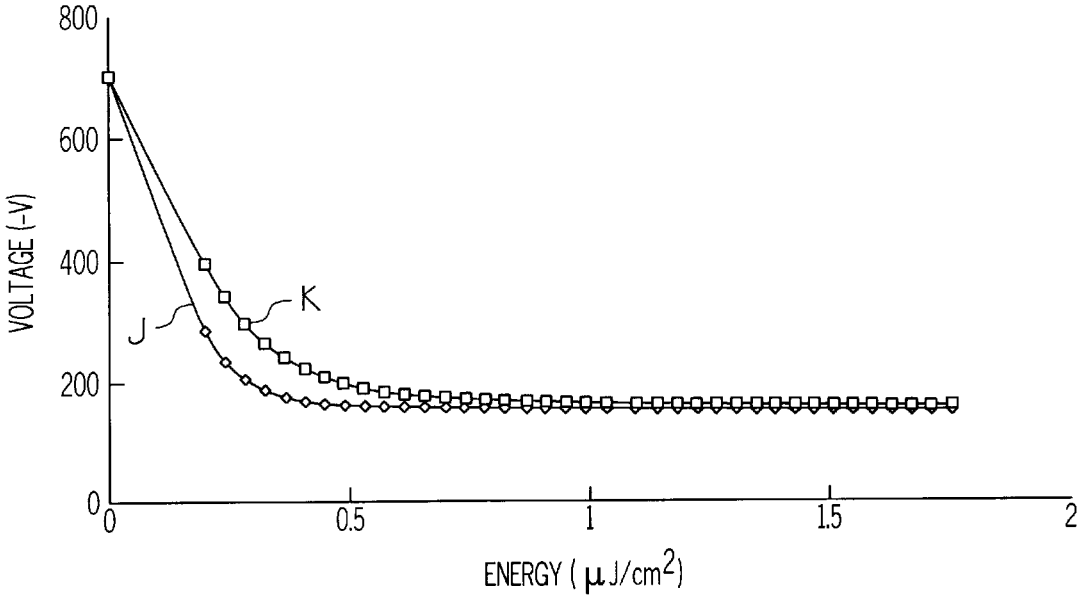

Photoconductors J and K were subjected to sensitivity measurements in accordance with the procedures set forth in Example 1, first using an expose to develop time of 76 ms, the results of which are set forth in FIG. 4A, and second using an expose to develop time of 257 ms, the results of which are set forth in FIG. 4B. In FIGS. 4A and 4B, curves J and K represent the performances of photoconductors J and K, respectively. The results set forth in FIGS. 4A and 4B demonstrate that further improved photoconductor sensitivity is obtained when different charge transport compounds are employed in the charge transport layer and the charge generation layer, respectively.

While the inventors do not intend to be limited by any one theory, it is believed that during the coating of the charge transport layer over the charge generation layer in a photoconductor such as photoconductor J according to the invention, a portion of the TPD charge transport compound contained in the charge generation layer diffuses into the charge transport layer and conversely some of the DEH charge transport compound contained in the charge transport layer diffuses into the charge generation layer. It is therefore surprising that this intermixing occurring at the interface of the charge generation layer and the charge transport layer does not result in trapping and a decrease in the sensitivity of the photoconductor. Rather, as demonstrated above, the sensitivity of the photoconductor is increased, particularly when the charge transport compound contained in the charge generation layer has been premilled with the charge generation compound in the absence of polymeric binder, according to the methods of the present invention. The use of TPD as the charge transport compound in the charge generation layer, in combination with the use of DEH as the charge transport compound in the transport layer, provides both cost advantages and improved wear as compared with a conventional photoconductor comprising a standard charge generation layer overcoated with a TPD-containing charge transport layer and exhibits improved sensitivity as compared with a conventional photoconductor comprising a standard charge generation layer overcoated with a DEH-containing charge transport layer.

The foregoing examples and various preferred embodiments of the present invention set forth herein are provided for illustrative purposes only and are not intended to limit the scope of the invention defined by the claims. Additional embodiments of the present invention and advantages thereof will be apparent to one of ordinary skill in the art and are within the scope of the invention defined by the following claims.

We claim:

1. A method of making a charge generation layer, comprising premixing a charge generation compound, a charge transport compound and solvent to form a premix essentially free of polymeric binder, mixing the premix of the charge generation compound, the charge transport compound and the solvent with at least one polymeric binder to form a dispersion, and coating the dispersion on a substrate.

2. A method according to claim 1, wherein the charge transport compound is soluble in the solvent.

3. A method according to claim 2, wherein the solvent comprises a ketone, an ether, or mixtures thereof.

4. A method according to claim 2, wherein a slurry of the charge generation compound and the solvent is milled before addition of the charge transport compound to form the premix.

5. A method according to claim 1, wherein the premix is free of polymeric binder.

6. A method according to claim 1, wherein the charge generation compound comprises a phthalocyanine compound.

7. A method according to claim 1, wherein the charge generation compound comprises a titanyl phthalocyanine compound.

8. A method according to claim 1, wherein the charge transport compound comprises a hydrazone, an aromatic amine, a substituted aromatic amine, or a mixture thereof.

9. A method according to claim 1, wherein the premix comprises from about 25 to about 75 weight percent of the charge transport compound and from about 75 to about 25 weight percent of the charge generation compound, based on the total content of charge generation compound and charge transport compound in the premix.

10. A method according to claim 1, wherein the premix comprises from about 1 to about 50 weight percent of the charge generation compound, from about 1 to about 50 weight percent of the charge transport compound and from about 5 to about 98 weight percent of solvent.

11. A method according to claim 1, wherein the dispersion comprises from about 5 to about 60 weight percent of the charge generation compound, from about 5 to about 60 weight percent of the charge transport compound and from about 10 to about 90 weight percent of the polymeric binder, based on the total content of charge generation compound, the charge transport compound and the polymeric binder.

12. A method according to claim 1, wherein the dispersion comprises from about 1 to about 30 weight percent of the charge generation compound, from about 1 to about 30 weight percent of the charge transport compound, from about 1 to about 30 weight percent of the polymeric binder and from about 5 to about 99 weight percent of the solvent.

13. A charge generation layer formed according to the process of claim 1.

14. A photoconductor, comprising a substrate, a charge transport layer, and a charge generation layer, wherein the charge transport layer comprises binder and a first charge transport compound, and the charge generation layer comprises binder, a charge generation compound and a second charge transport compound, wherein the first and second charge transport compounds may be the same or different, and further wherein the charge generation layer is made by a process comprising premixing the charge generation compound, the second charge transport compound and solvent to form a premix essentially free of polymeric binder, mixing the premix of the charge generation compound, the second charge transport compound and the solvent with at least one polymeric binder to form a dispersion, and coating the dispersion on a substrate.

15. A photoconductor according to claim 14, wherein the weight ratio of the charge generation compound to the second charge transport compound in the charge generation layer is not less than about 1:3.

16. A photoconductor as defined by claim 14, wherein the charge generation compound comprises a phthalocyanine.

17. A photoconductor as defined by claim 14, wherein the charge generation layer comprises at least about 10 weight percent, based on the weight of the charge generation layer, of the charge generation compound.

18. A photoconductor as defined by claim 14, wherein the first and second charge transport compounds are different.

19. A photoconductor as defined by claim 14, wherein the first and second charge transport compounds are the same.

20. A photoconductor as defined by claim 14, wherein the first and second charge transport compounds individually comprise hydrazones, aromatic amines, substituted aromatic amines, or mixtures thereof.

21. A photoconductor as defined by claim 14, wherein the charge generation compound comprises a metal phthalocyanine and the first and second charge transport compounds individually comprise hydrazones, aromatic amines or substituted aromatic amines, or mixtures thereof.

22. A photoconductor as defined by claim 14, wherein the charge generation layer comprises from about 5 to about 60 weight percent of the charge generation compound, from about 5 to about 60 weight percent of the second charge transport compound, and from about 20 to about 80 weight percent of the binder.

* * * * *